US005636820A

United States Patent [19]

Domenig

[11] Patent Number: 5,636,820

[45] Date of Patent: Jun. 10, 1997

[54] BRACKET FOR SUPPORTING A DRAWER GUIDE IN A FURNITURE ARTICLE

[75] Inventor: Georg Domenig, Kernersville, N.C.

[73] Assignee: Grass America, Inc., Kernersville, N.C.

[21] Appl. No.: 440,109

[22] Filed: May 12, 1995

[51] Int. Cl.[6] ..... A47B 96/06

[52] U.S. Cl. ..... 248/220.21; 312/334.5; 248/200

[58] Field of Search ..... 248/220.21, 220.31, 248/200, 254, 262, 267, 220.41–220.43, 231.9; 312/334.5, 330.1; 403/230, 240, 326

[56] References Cited

U.S. PATENT DOCUMENTS

| | | | |
|---|---|---|---|
| 4,501,453 | 2/1985 | Gutner et al. | 312/330.1 |
| 4,815,796 | 3/1989 | Rock | 312/330.1 |
| 4,874,212 | 10/1989 | Rock | 312/330.1 |
| 5,257,861 | 11/1993 | Domenig | 312/334.5 |
| 5,306,080 | 4/1994 | Lautenschlager | 312/334.5 |
| 5,349,723 | 9/1994 | Domenig | 312/330.1 |
| 5,359,752 | 11/1994 | Domenig | 312/330.1 |
| 5,387,033 | 2/1995 | Domenig | 312/330.1 |

FOREIGN PATENT DOCUMENTS

| | | | |
|---|---|---|---|
| 441161 | 8/1991 | European Pat. Off. | 312/330.1 |

*Primary Examiner*—Korie Chan
*Assistant Examiner*—Gwendolyn W. Baxter
*Attorney, Agent, or Firm*—Petree Stockton, LLP

[57] ABSTRACT

A bracket for mounting a drawer guide in a furniture article such as a desk or cabinet has a base provided with opposing retaining flanges on the front of the base for receiving a drawer guide for lateral adjustment and fasteners disposed on the back of the base for supporting the base on a furniture article wall. The fasteners include a positioning portion and a resilient spring leg which is extendable through the wall for releasably securing the base to the furniture article wall.

7 Claims, 2 Drawing Sheets

BRACKET FOR SUPPORTING A DRAWER GUIDE IN A FURNITURE ARTICLE

BACKGROUND OF THE INVENTION

1. Field of the Invention

The present invention relates to drawer guide mounting brackets for use in a furniture article such as a desk or cabinet, and more particularly to a new and improved mounting bracket used in connection with a drawer guide, which is releasably securable to a furniture article wall, the bracket having a base provided with drawer guide receiving means on the front of the base and a fastener on the back of the base which includes a resilient spring leg extendable through the furniture article wall for releasably engaging the furniture article wall rear face.

2. Description of the Prior Art

Various types of mounting brackets for desk and cabinet drawers have been used in the furniture and cabinet industry for many years. Generally, such brackets are not precisely designed or engineered to achieve stability, long wear or efficient operation. Such brackets have adjustable elements, usually formed directly in the bracket body, making the bracket difficult to adjust, insufficient to achieve drawer stability with respect to the desk or cabinet, quick to deteriorate, and relatively difficult to install and remove.

There is a current need to provide more precisely designed and manufactured mounting brackets which operate with greater efficiency, adjustability, and which are easier to install and remove while retaining the costs associated with the design and manufacture of such devices within the same range as presently experienced with conventional brackets.

While improved brackets of the type disclosed in U.S. Pat. No. 5,257,861 partially address this need, the usefulness of such brackets is limited in that they are designed with a pair of fasteners on the back of the bracket base, each of which fasteners includes a pair of engaging ears extendable through the furniture article wall to engage the furniture wall rear face. The design of such brackets requires simultaneous application of force to both of the engaging ears of each fastener to release the fasteners from engagement to the wall rear face. This requires, for example, the use of two hands at the same time in order to disengage the engaging ears of both fasteners from the wall rear face, and any other operation such as removal of the bracket from the front face of the wall requires assistance;

The present invention addresses this need and provides a bracket utilizing a fastener such that the bracket can be easily installed in a desk or cabinet for receiving the drawer guide and which provides for easy unassisted removal of the bracket from the desk or cabinet.

SUMMARY OF THE INVENTION

The general purpose of the present invention, which will be described in greater detail, is to provide a new and improved mounting bracket to be used on a desk or cabinet and with a drawer guide, that has all, and more, of the advantages of prior art brackets and none of the disadvantages.

To attain this purpose, a representative embodiment of the present invention is illustrated in the drawings. The bracket of the present invention makes use of a base having drawer guide receiving means disposed on the base front and a fastener disposed on the base back having a single resilient spring leg extendable through the base for releasably securing the base to the wall of a furniture article such as a desk or cabinet. The resilient spring leg includes a free end for releasably engaging the rear face of the furniture article wall. Preferably, a pair of such fasteners are provided on the base back to cooperatively secure the base to the furniture article wall.

The fastener also includes a positioning portion configured as a dowel shaped member which engages in the furniture article wall and which has a bottom connected to the base back and a top spaced from the bottom a distance at least as great as the thickness of the furniture article wall. The resilient spring leg also includes a fixed end which is connected to the top of the fastener positioning portion. The positioning portion is provided with a recess defined as a channel, and the free end of the resilient spring leg extends at least partly into the positioning portion recess. The resilient spring leg is generally U-shaped, and the free end of the spring leg includes an enlargement.

A pair of opposing flanges, preferably spring flanges, are provided on the front of the base for cooperatively receiving a drawer guide to enable preselected lateral adjustment of the drawer guide, and a stop is provided on the base front to limit the drawer guide lateral adjustment.

The fastener, and preferably a pair of the fasteners, support the bracket in bore holes formed in the furniture article wall. The positioning portion of the fastener is defined as a dowel having an outside diameter about equal to the inside diameter of a bore hole, which seats securely in the bore hole. In order to install the bracket, each fastener is pressed into a corresponding bore hole which deflects the free end of the resilient spring leg and, when the spring leg free end extends completely through the wall, the free end of the resilient spring leg snaps into engagement with the rear face of the wall, securing the bracket to the wall. The bracket can be easily released from engagement to the wall by the application of force to the spring leg free end on each fastener, requiring only one hand to release the bracket and leaving the other hand free to perform any other operation such as removal of the bracket from the front face of the wall.

This outline focusses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved bracket utilizing a fastener enabling easy installation of the bracket in a furniture article, such as a desk or cabinet, for receiving a drawer guide, which has all of the advantages, and more, of prior art brackets and none of the disadvantages.

It is another object of the present invention to provide a new and improved bracket of the type described that is more reliable and functional than those presently available.

Yet another object of the present invention is to provide a new and improved releasable mounting bracket which, once installed, can be easily disengaged and removed from a furniture article.

Still another object of the present invention is to provide a mounting bracket of the type described that enables repeated preselected lateral adjustments to be made to a drawer carried on the drawer guide received by the mounting bracket.

A further object of the present invention is to provide a new and improved mounting bracket utilizing a stop limiting lateral movement of the drawer guide.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
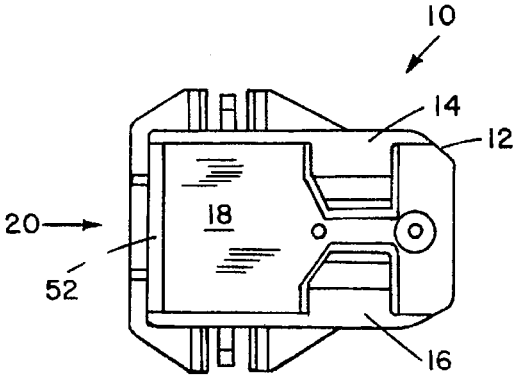
FIG. 1 is a plan view of the bracket comprising the present invention.
Figure 2:
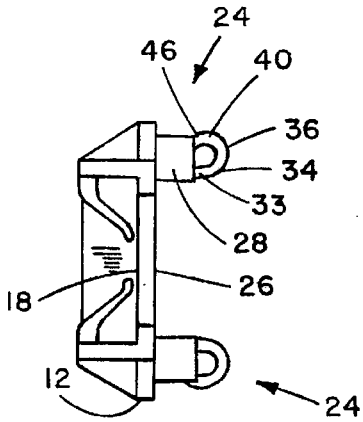
FIG. 2 is a front elevational view of the bracket shown in FIG. 1.
Figure 8:
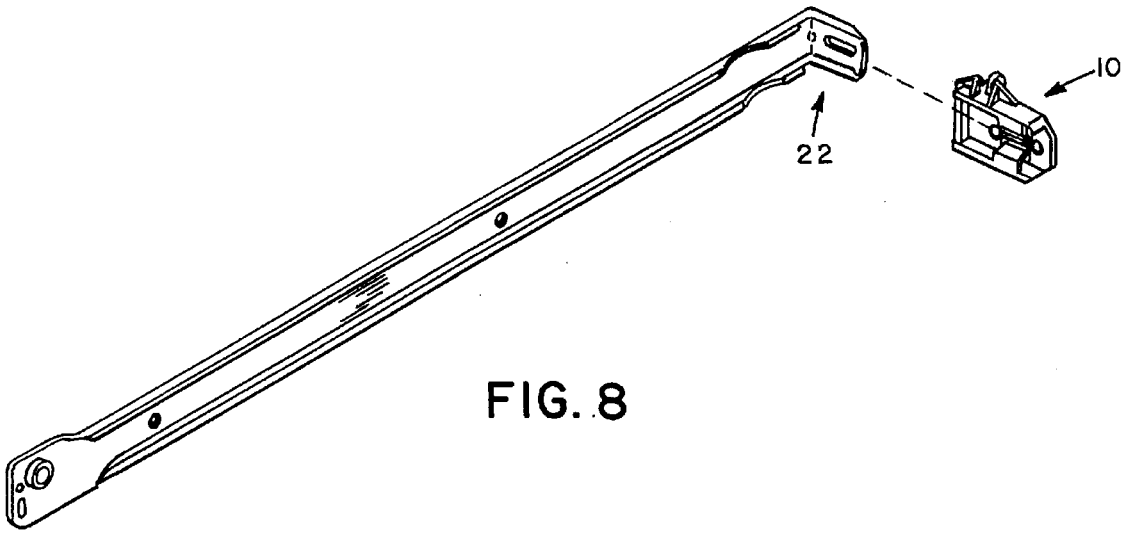
FIG. 8 is a perspective view of a drawer guide cooperatively and adjustably received by the bracket shown in FIGS. 1 through 7.

Referring now to the drawings, and specifically to FIGS. 1 and 2, a bracket shown generally as 10 has a base 12 and opposing retaining flanges 14, 16 resiliently connected to the front 18 of base 12 to cooperatively receive (see arrow 20) a drawer guide tongue portion, shown generally as 22 in FIG. 8, for preselected lateral adjustment of the drawer guide. Drawer guide tongue portion 22 is positioned against front 18 of base 12 and engaged under retaining flanges 14, 16, and a stop 52 on front 18 of base 12 prevents withdrawal of drawer guide tongue portion 22. Alternatively, bracket base front 18 may be provided with spring retaining flanges configured to cooperatively receive drawer guide tongue portion 22 in snap-in engagement, or bracket base front 18 may be provided with rigid or semirigid flanges configured to cooperatively receive a moveable drawer guide plate adapted to connect a tongueless drawer guide.

Figure 4:
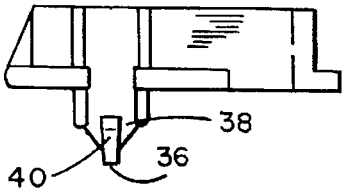
FIG. 4 is a side elevational view of the bracket shown in FIGS. 1 through 3.
Figure 6:
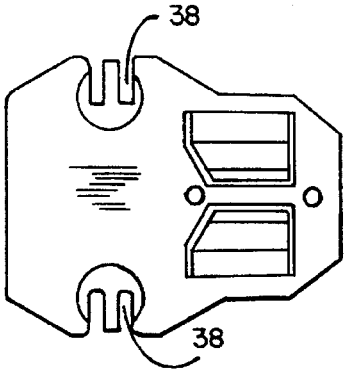
FIG. 6 is a bottom view of the bracket shown in FIGS. 1 through 5.

Bracket base 12 is supported on a furniture article such as a desk or cabinet by a fastener shown generally as 24 disposed on the back 26 of base 12. Fastener 24 has a positioning portion 28 which is dowel-shaped and which has a bottom 30 connected to base back 26 and a top 32 to which fixed end 34 of U-shaped resilient spring leg 36 is connected. Positioning portion 28 of fastener 24 is provided with a recess 38 defined as a channel as shown in FIGS. 4 and 6, and free end 40 of spring leg 36 extends at least partly into recess 38.

Figure 5:
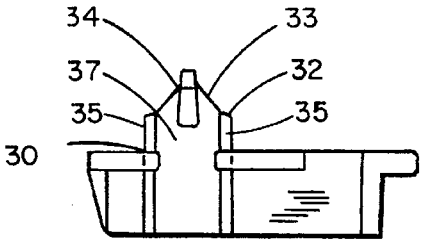
FIG. 5 is an elevational view of the opposite side of the bracket shown in FIG. 4.
Figure 3:
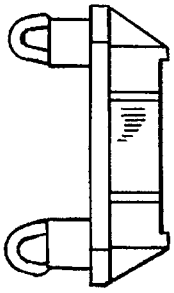
FIG. 3 is a rear elevational view of the bracket shown in FIGS. 1 and 2.

As shown in FIGS. 2 and 5, a recess or channel 38 is defined in positioning portion 28 of fastener 24 by a pair of opposing side walls 35 connected by back wall 37 of positioning portion 28, and the top 32 of positioning portion 28 is defined by the respective tops of side walls 35 and back wall 37. Fastener 24 also includes a generally triangular shaped tapered portion 33 extending from the top of back wall 37, and fixed end 34 of spring leg 36 is connected to tapered portion 33 which is in turn connected to top 32 of positioning portion 28.

Figure 7:
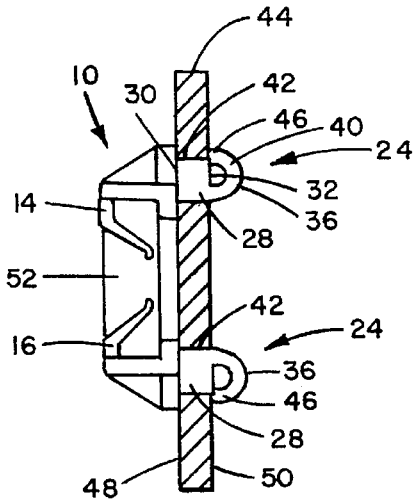
FIG. 7 is front elevational view of the bracket shown in FIGS. 1 through 6 engaged in a furniture article wall shown in cross section.

Preferably, a pair of mirror identical fasteners 24 support the bracket in a pair of corresponding bore holes 42 formed in the furniture article wall 44 as shown in FIG. 7. Positioning portion 28 has an outside diameter about equal to the inside diameter of bore hole 42 to enable positioning portion 28 to seat securely in bore hole 42, and positioning portion top 32 is spaced from positioning portion bottom 30 by a distance at least as great as the distance between the front face 48 and the rear face 50 of furniture article wall 44. Spring leg free end 40, including enlargement 46, extends partly into recess 38 of positioning portion 38 and partly outside recess 38.

The bracket is installed by pressing fasteners 24 into bore holes 42 deflecting free end 40 of spring leg 36 and enlargement 46 completely into positioning portion recess 38 allowing spring leg 36 to pass through bore hole 4.2. When spring leg free end 40 extends completely through furniture article wall 44, free end 40 springs back to its original position with spring leg free end enlargement 46 engaged against rear face 50 of furniture article wall 44. The bracket can be easily released from engagement with furniture article wall 44 by the application of force simultaneously on spring leg free end 40 of each one of mirror identical fasteners 24, for example by pinching between the forefinger and thumb of one hand and pressing toward the furniture article wall rear face 50.

Obviously, any number of materials may be used to form the bracket and its components described herein, and exceptional success has been experienced by use of semirigid plastic material for the bracket, although other materials may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A bracket for supporting a drawer guide on a furniture article wall having front and rear faces spaced by a predetermined wall thickness comprising:

a base having a front and a back:

means disposed on the front of the base for receiving said drawer guide; and a fastener disposed on the back of the base having a generally dowel-shaped positioning portion extending from the back of the base and engageable in the furniture article wall, the positioning portion including a pair of opposing side walls and a back wall connecting the side walls, the side walls and back wall defining a channel in the positioning portion, and the back wall of the positioning portion having a top spaced from the back of the base, the fastener also including a tapered portion extending from the top of the back wall of the positioning portion and a single generally U-shaped resilient spring leg having a fixed end connected to the tapered portion and a free end which is extends at least partly into the channel of the positioning portion and which is extendable through said furniture article wall for engaging said rear face of the furniture article wall and releaseably securing the base to the furniture article wall.

2. The bracket according to claim 1, said spring leg free end including an enlargement.

3. The bracket according to claim 2, wherein the tapered portion is generally triangular shaped.

4. The bracket according to claim 3, further comprising a pair of said fasteners cooperatively and releasably securing said base to said furniture article wall.

5. The bracket according to claim 4, said drawer guide receiving means comprising a pair of opposing flanges connected to said base front cooperatively receiving said drawer guide.

6. The bracket according to claim 5, wherein said opposing flanges are spring flanges adapted to enable preselected lateral adjustment of said drawer guide.

7. The bracket according to claim 6, said drawer guide receiving means further comprising a stop connected to said base front limiting said preselected lateral adjustment.

* * * * *